US006547536B2

(12) United States Patent
Seo

(10) Patent No.: US 6,547,536 B2
(45) Date of Patent: Apr. 15, 2003

(54) RECIPROCATING COMPRESSOR HAVING A DISCHARGE PULSATION

(75) Inventor: Seung-don Seo, Kwangju (KR)

(73) Assignee: Samsung Kwangju Electronics., Ltd., Kwangju (KR)

( * ) Notice: Subject to any disclaimer, the term of this patent is extended or adjusted under 35 U.S.C. 154(b) by 0 days.

(21) Appl. No.: 09/946,296

(22) Filed: Sep. 4, 2001

(65) Prior Publication Data

US 2002/0136646 A1 Sep. 26, 2002

(30) Foreign Application Priority Data

Jan. 19, 2001 (KR) ..... 2001-3270
Mar. 7, 2001 (KR) ..... 2001-11836

(51) Int. Cl.[7] ..... F04B 53/00

(52) U.S. Cl. ..... 417/312; 417/415; 181/212; 181/403

(58) Field of Search ..... 417/312, 403, 417/415; 181/212, 403

(56) References Cited

U.S. PATENT DOCUMENTS 4,401,418 A * 8/1983 Fritchman ..... 417/312
5,173,034 A * 12/1992 Riffe ..... 417/312
6,176,688 B1 * 1/2001 Collings et al. ..... 417/312
6,280,161 B1 * 8/2001 Seo ..... 417/540

FOREIGN PATENT DOCUMENTS

JP 02002048062 A * 2/2002

* cited by examiner

*Primary Examiner*—Charles G. Freay
*Assistant Examiner*—John F Belena
(74) *Attorney, Agent, or Firm*—Ladas & Parry

(57) ABSTRACT

A reciprocating compressor has a pair of discharge mufflers disposed on a lower portion of a cylinder block, a first and a second refrigerant channels for intercommunicating the pair of discharge mufflers with a refrigerant discharge chamber of a cylinder head, a pair of muffler covers for sealing the pair of discharge mufflers, respectively, a connecting pipe for connecting the pair of muffler covers with each other, and a refrigerant discharge pipe connected to either one of the pair of muffler covers that is intercommunicated with the second refrigerant channel. The first and the second refrigerant channels have refrigerant inflow sides connected to the refrigerant discharge chamber, and refrigerant outflow sides having a cross-sectional area smaller than the cross-sectional area of the refrigerant inflow sides. The relationship between the cross-sectional areas of the refrigerant outflow side of the first refrigerant channel, the refrigerant outflow side of the second refrigerant channel, and the connecting pipe, is varied according to an exhaust air volume of the compressor. In the reciprocating compressor, by increasing flow resistance of the refrigerant channels, discharge pulsation of refrigerant can be reduced.

9 Claims, 6 Drawing Sheets

RECIPROCATING COMPRESSOR HAVING A DISCHARGE PULSATION

BACKGROUND OF THE INVENTION

1. Field of the Invention

The present invention relates to a reciprocating compressor, and more particularly to a reciprocating compressor having a structure for reducing a pulsation that is generated during a refrigerant discharge.

2. Description of the Related Art

Generally, a reciprocating compressor is widely used in freezing appliances such as refrigerator, or the like, to compress refrigerant.

As shown in FIG. 1, the reciprocating compressor includes a casing 10 having an upper shell 11 and a lower shell 12, a compressing device portion formed in a lower portion of the casing 10 and having components for compressing refrigerant, and an electric device portion 20 for driving the components of the compressing device portion.

The electric device portion 20 includes a stator 21, a rotator 22 rotated by an electro-magnetic operation with the stator 21, and a crank shaft 23 press-fitted in the center portion of the rotator 22.

The compressing device portion includes a cylinder block 30 disposed in the lower portion of the casing 10, a connecting rod 40 eccentrically connected to a lower end of the crank shaft 23, a piston 50 connected to a leading end of the connecting rod 40 to linearly reciprocate within a compressing chamber 31 defined in the cylinder block 30, and a cylinder head 60 disposed on a front side 32 (FIG. 2) of the cylinder block 30 for sealing the compressing chamber 31. The cylinder head 60 (FIG. 1) has a refrigerant intake chamber 61 and a refrigerant discharge chamber 62 formed at upper and lower portion thereof, respectively. Between the cylinder head 60 and the front side 32 of the cylinder block 30, a valve assembly 70 is disposed. The valve assembly 70 controls a flow rate of the refrigerant between the refrigerant intake chamber 61 and the compressing chamber 31 and also between the refrigerant discharge chamber 62 and the compressing chamber 31.

Meanwhile, at an upper portion of the cylinder head 60, an intake muffler 80 is disposed, intercommunicating with the refrigerant intake chamber 61. The intake muffler 80 is connected to a refrigerant intake pipe 81, through which the refrigerant is drawn from an evaporator (not shown).

As shown in FIGS. 2 and 3, a discharge muffler 33 protrudes from a lower surface of the cylinder block 30, and a muffler cover 34 provides a cover for sealing the discharge muffler 33. The muffler cover 34 is connected to a refrigerant discharge pipe 35 through which the refrigerant is fed to a condenser (not shown). On the front side 32 of the cylinder block 30, a refrigerant discharge port 32*a* is formed, intercommunicating with the discharge muffler 33 through a refrigerant channel 37.

Meanwhile, the valve assembly 70 includes an intake valve plate 71 having an intake valve 71*a* formed thereon, and a discharge valve plate 72 having a discharge valve 72*a* formed thereon. The intake valve 71*a* controls the flow rate of the refrigerant between the compressing chamber 31 and the refrigerant intake chamber 61 of the cylinder head 60, while the discharge valve 72*a* controls the flow rate of the refrigerant between the compressing chamber 31 and the refrigerant discharge chamber 62 of the cylinder head 60.

In the compressor constructed as above, the discharge of the refrigerant after being compressed by the piston is as follows:

First, the piston is retreated in the compressing chamber 31 by the rotation of the crank shaft 23 to a bottom dead center (to a left hand side of FIG. 1), and low temperature and low pressure refrigerant is fed from the evaporator (not shown). The refrigerant sequentially passes through the intake muffler 80 and the refrigerant intake chamber 61 of the cylinder head 60, and flows into the compressing chamber 31. Next, by the rotation of the crank shaft 23, the piston 50 is advanced in the compressing chamber 31 to a top dead center (right hand side of FIG. 1), and accordingly the refrigerant is compressed to high temperature and high pressure refrigerant. The compressed refrigerant stays in the refrigerant discharge chamber 62 of the cylinder head 62 for a predetermined time, and flows to the discharge muffler 33 through the refrigerant discharge port 32*a* and the refrigerant channel 37. Then, the high temperature and high pressure refrigerant is discharged to the condenser (not shown) through the refrigerant discharge pipe 35 that is connected to the muffler cover 34.

In the above reciprocating compressor, however, since the refrigerant is drawn, compressed, and discharged by the reciprocating movement of the piston 50 in the compressing chamber 31, the consistent discharge of the refrigerant can not be guaranteed. Accordingly, a discharge pulsation of the refrigerant occurs. The discharge pulsation of the refrigerant causes noise and vibration of the compressor. In particular, the noise produced in a frequency range of 120 Hz–500 Hz, which is a characteristic frequency of the components of the freezing appliance, causes resonance with the components, and increases the level of noise and vibration of the freezing appliance.

The discharge pulsation of the refrigerant can be reduced by increasing a streaming resistance of the discharged refrigerant. That is, by reducing a sectional area of the refrigerant channel 37 between the refrigerant discharge chamber 62 and the discharge chamber 33, or by lengthening the refrigerant channel 37, the discharge pulsation of the refrigerant can be reduced. However, making the cross-sectional area of the refrigerant channel 37 smaller hinders smooth refrigerant flow between the refrigerant discharge chamber 62 and the discharge muffler 33. Accordingly, the compressing efficiency deteriorates. Further, since the refrigerant channel 37 is passed through the interior of the cylinder block 30, the length of the refrigerant channel 37 is limited.

SUMMARY OF THE INVENTION

The present invention has been made to overcome the above-described problems of the related art, and accordingly, it is an object of the present invention to provide a reciprocating compressor having an improved refrigerant discharging structure, capable of reducing a discharge pulsation of refrigerant without dropping compressing efficiency of the refrigerant compressor.

The above object is accomplished by a reciprocating compressor according to the present invention, including a pair of discharge mufflers disposed on the lower portion of a cylinder block; a first and a second refrigerant channels interconnecting the pair of discharge mufflers and a refrigerant discharge chamber of a cylinder head; a pair of muffler covers for sealing the pair of discharge mufflers, respectively; a connecting pipe for connecting the pair of muffler covers with each other; and a refrigerant discharge pipe connected to one of the pair of muffler covers that is interconnected with the second refrigerant channel. The first and the second refrigerant channels have refrigerant inflow sides which are connected to the refrigerant discharge chamber and have a predetermined cross-sectional area, and refrigerant outflow sides which are connected to the pair of discharge mufflers and have a cross-sectional area smaller than the cross-sectional area of the refrigerant inflow sides. A discharge pulsation of refrigerant is reduced by varying a proportion between the cross-sectional areas of the refrigerant outflow side of the first refrigerant channel, the refrigerant outflow side of the second refrigerant channel, and the connecting pipe according to an exhaust air volume of the compressor, respectively.

In the reciprocating compressor having exhaust air volume of 3.0 cc, it is preferable that the relationship between a cross-sectional diameter of the refrigerant outflow side of the first refrigerant channel, the cross-sectional diameter of the refrigerant outflow side of the second refrigerant channel, and an inner diameter of the connecting pipe is expressed approximately by 2:2:1.8. More specifically, when the sectional diameter of the refrigerant inflow sides of the first and the second refrigerant channels are 6.4 mm, respectively, the cross-sectional diameter of the refrigerant outflow side of the first refrigerant channel is 2.0 mm, and the cross-sectional diameter of the refrigerant outflow side of the second refrigerant channel is 2.0 mm, and the inner diameter of the connecting pipe is 1.78 mm.

In the reciprocating compressor having exhaust air volume of 3.7–4.3 cc, a relationship between the cross-sectional diameter of the refrigerant outflow side of the first refrigerant channel, the cross-sectional diameter of the refrigerant outflow of the second refrigerant channel, and the inner diameter of the connecting pipe is expressed approximately by 2:3.5:1.8. Accordingly, when the cross-sectional diameter of the refrigerant inflow sides of the first and the second refrigerant channels are 2.0 mm, respectively, the cross-sectional diameter of the refrigerant outflow side of the second refrigerant channel is 3.5 mm, and the inner diameter of the connecting pipe is 1.78 mm.

In the reciprocating compressor having exhaust air volume of 5.2–6.2 cc, a relationship between the cross-sectional diameter of the refrigerant outflow side of the first refrigerant channel, the cross-sectional diameter of the refrigerant outflow side of the second refrigerant channel, and the inner diameter of the connecting pipe is expressed approximately by 2:3.5:2.2. Accordingly, when the cross-sectional diameters of the refrigerant inflow sides of the first and the second refrigerant channels are 6.4 mm, respectively, the cross-sectional diameter of the refrigerant outflow side of the first refrigerant channel is 2.0 mm, and the cross-sectional diameter of the refrigerant outflow side of the second refrigerant channel is 3.5 mm, and the inner diameter of the connecting pipe is 2.16 mm.

Meanwhile, it is preferable that the connecting pipe has bent ends formed on both ends at a predetermined angle and inserted in the pair of muffler covers toward inner walls of the muffler covers.

BRIEF DESCRIPTION OF THE DRAWINGS

The above object and other features of the present invention will be clarified by the following description with the attached drawings, in which.

DETAILED DESCRIPTION OF THE PREFERRED EMBODIMENTS

Figure 1:
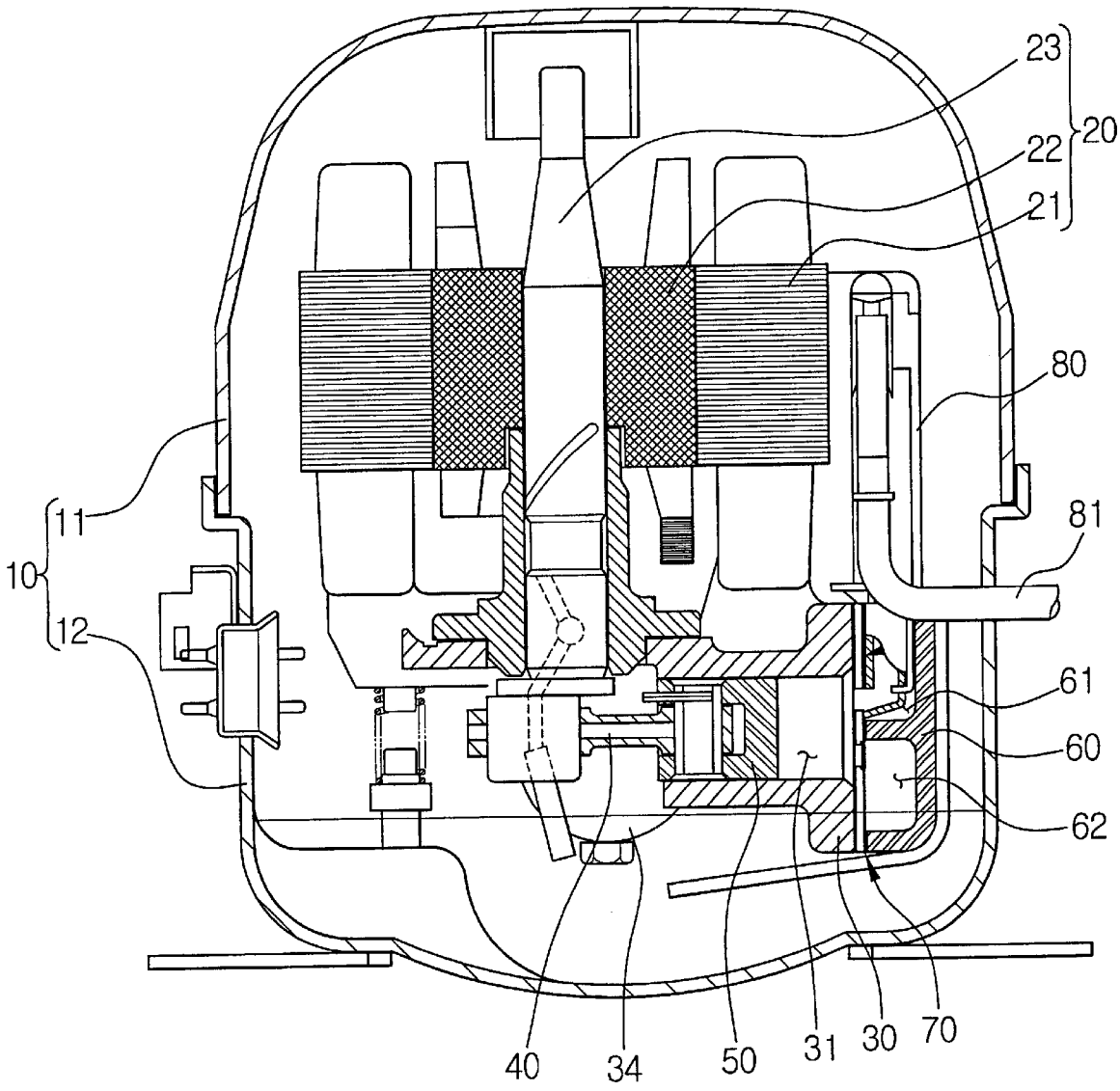
FIG. 1 PRIOR ART
FIG. 1 is a sectional view of a conventional reciprocating compressor.
Figure 2:
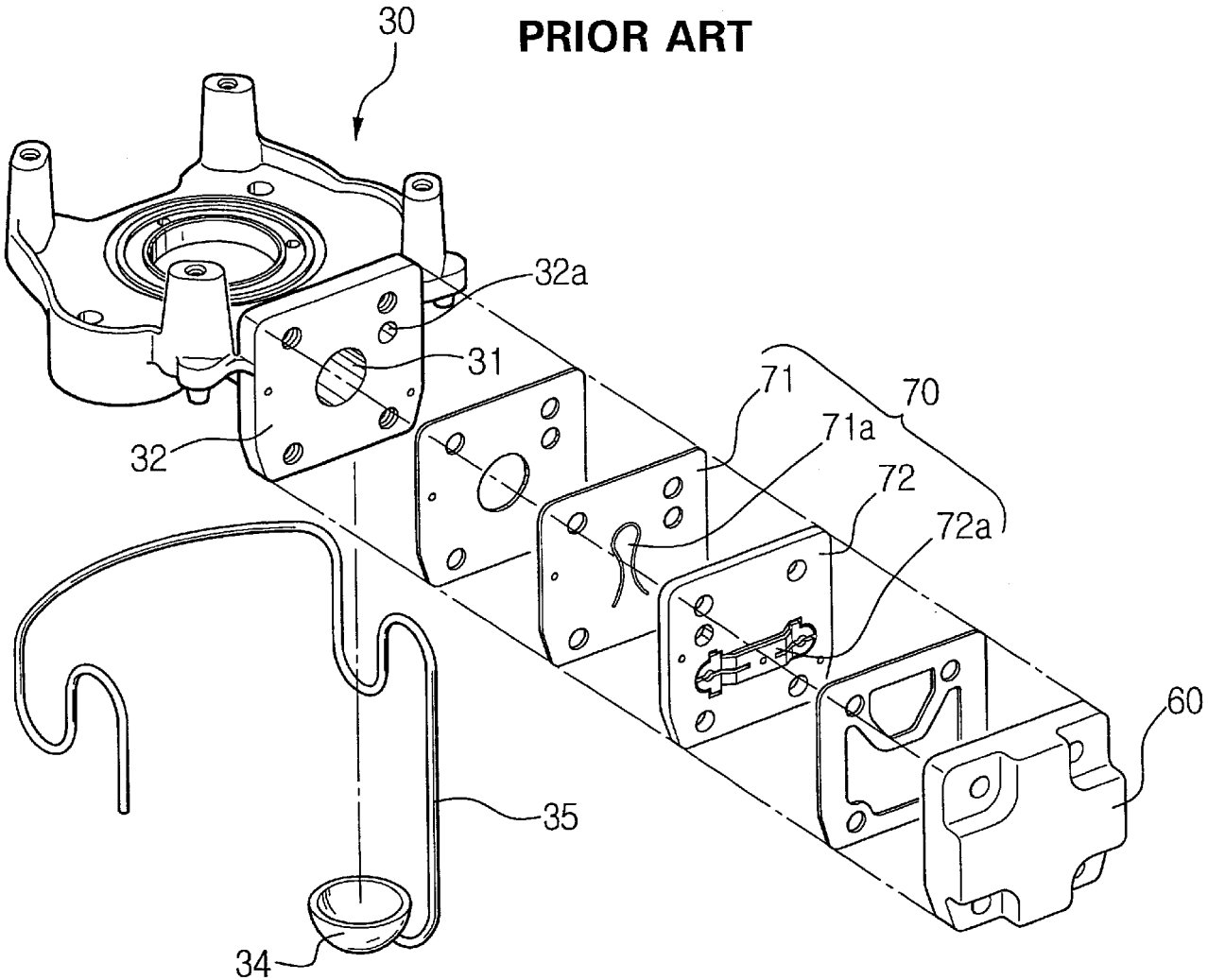
FIG.2 PRIOR ART
FIG. 2 is an exploded perspective view partially showing a compressing device portion of the compressor of FIG. 1.
Figure 3:
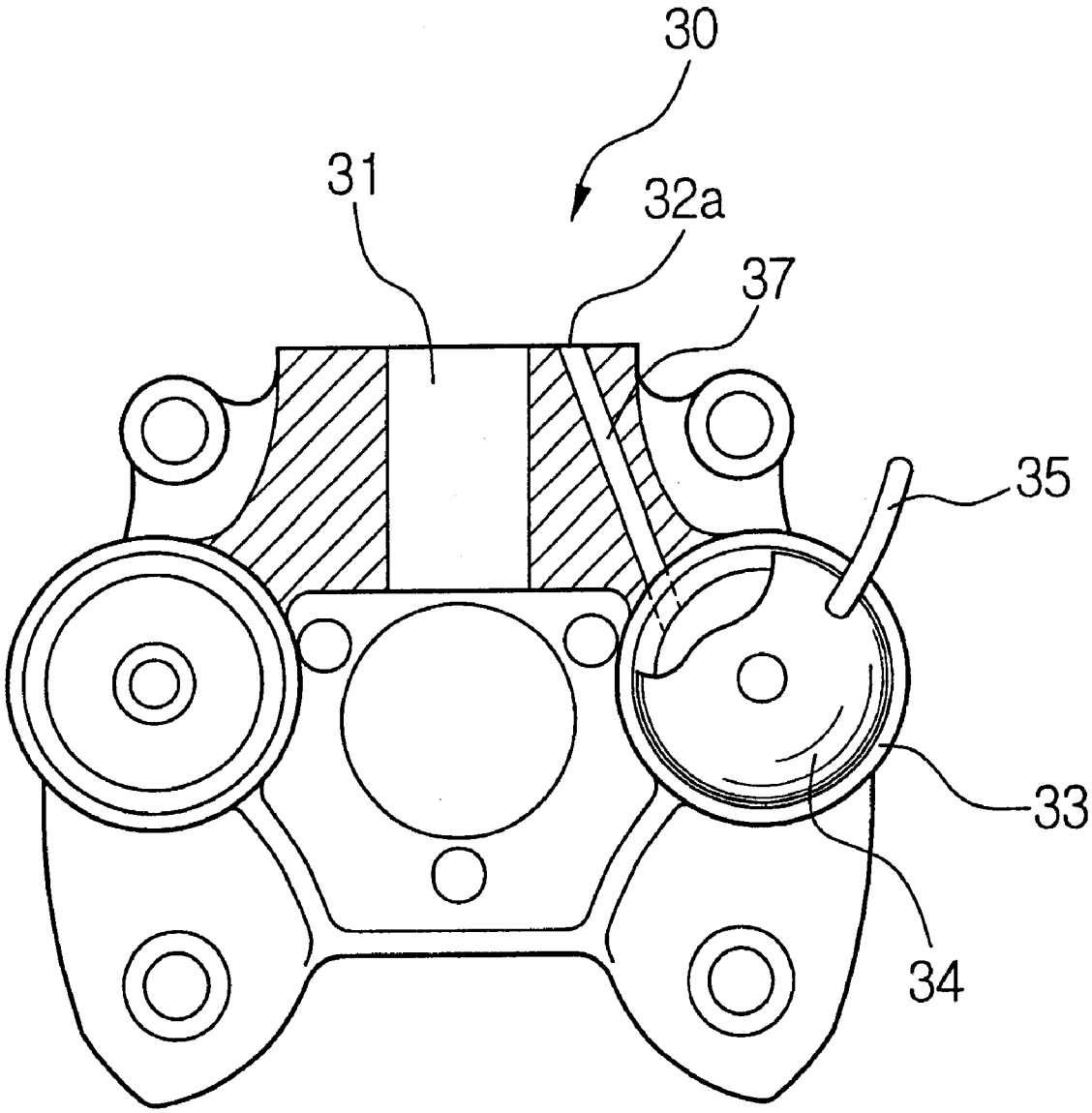
FIG.3 PRIOR ART
FIG. 3 is a bottom view partially showing the compressing device portion of FIG. 2.

This invention will be described in further detail by way of example with reference to the attached drawings. Here, almost all structure of the reciprocating compressor according to the present invention is identical to the structure of the general reciprocating compressor of FIG. 1, except for a part of the compressing device portion, and accordingly, the like elements will be given the same reference numerals while repetitious description will be omitted as much as possible.

Figure 4:
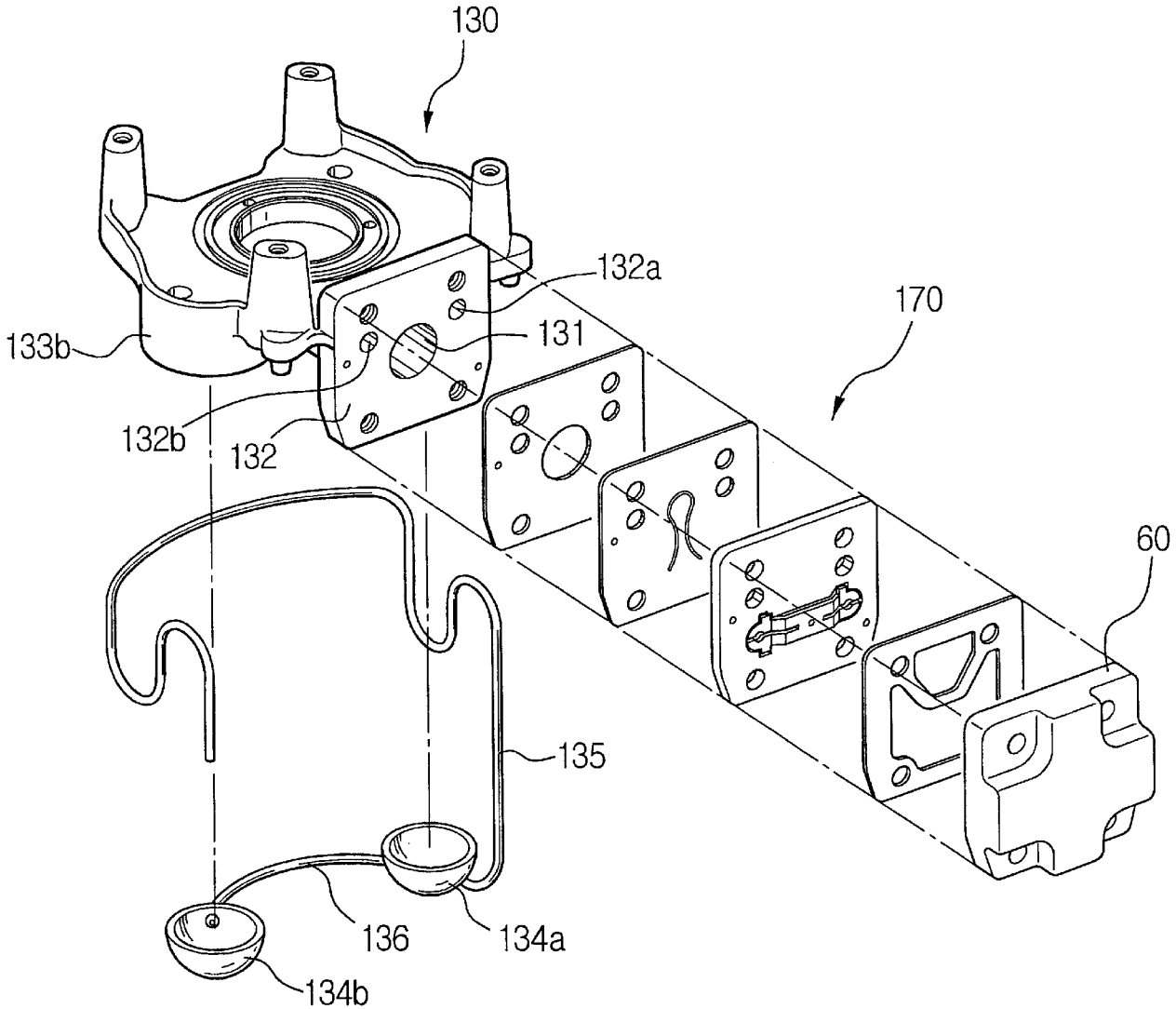
FIG. 4 is an exploded perspective view partially showing the compressing device portion of a reciprocating compressor according to the present invention.

As show in FIG. 4, the reciprocating compressor according to the present invention includes a cylinder block 130, a cylinder head 60 formed on a front side 132 of the cylinder block 130, and a valve assembly 170 disposed between the cylinder block 130 and the cylinder head 60.

On the front side 132 of the cylinder block 130, a pair of refrigerant discharge ports, i.e., the first and the second refrigerant discharge ports 132*a* and 132*b* are formed in parallel with each other, intercommunicating with the refrigerant discharge chamber 62 (FIG. 1). From a lower surface of the cylinder block 130, a pair of discharge mufflers, i.e., the first and the second discharge mufflers 133*a* and 133*b* (FIGS. 4 and 5) protrude.

The first and the second muffler covers 134*a* and 134*b* are disposed on the first and the second discharge mufflers 133*a* and 133*b*, respectively. The first and the second muffler covers 134*a* and 134*b* are formed in the shape of a hemisphere, and interconnected through a connecting pipe 136 that is formed in the shape of a circular arc having a predetermined radius of curvature. The first muffler cover 134*a* is connected to a refrigerant discharge pipe 135 through which the refrigerant is fed to the condenser (not shown).

Figure 5:
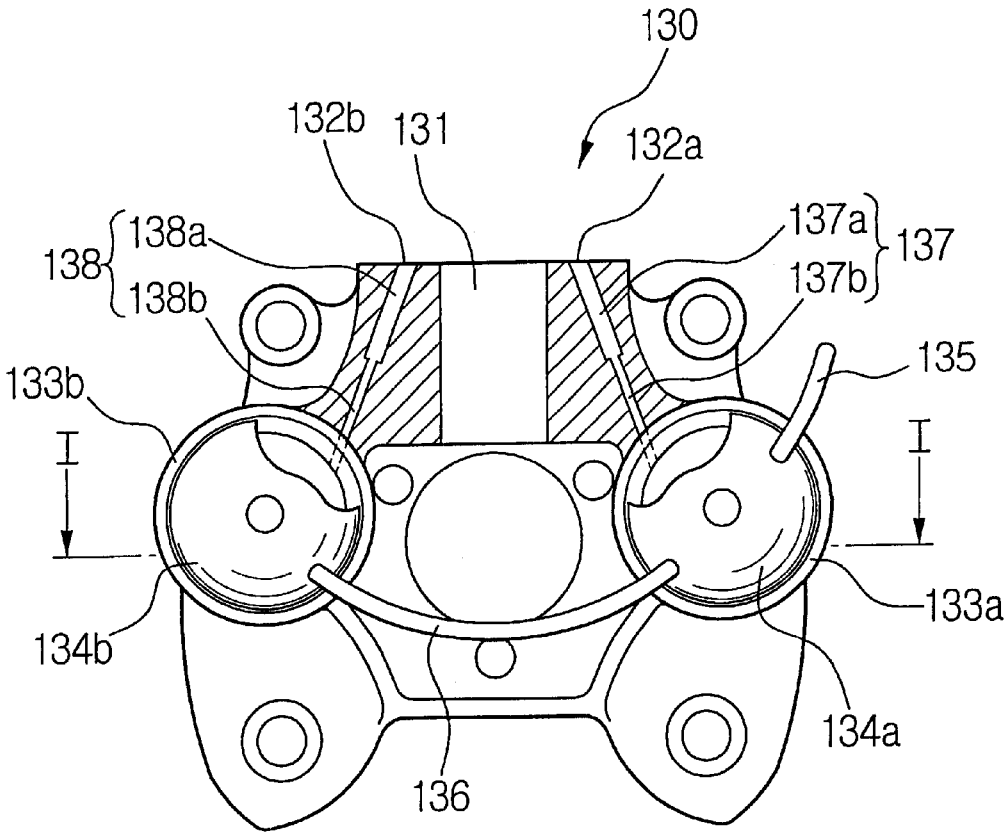
FIG. 5 is a bottom view partially showing the compressing device portion of FIG. 4.

As shown in FIG. 5, the first refrigerant discharge port 132*a* is interconnected with the first discharge muffler 133*a* by a first refrigerant channel 137 passed through the cylinder block 130, while the second refrigerant discharge port 132*b* is interconnected with the second discharge muffler 133*b* by a second refrigerant channel 138. The first and the second refrigerant channels 137 and 138 have refrigerant inflow sides 137*a* and 138*a* and refrigerant outflow sides 137*b* and 138*b*, and the cross-sectional area of the refrigerant inflow sides 137*a* and 138*a* is smaller than the cross-sectional area of the refrigerant outflow sides 137*b* and 138*b*.

Figure 6:
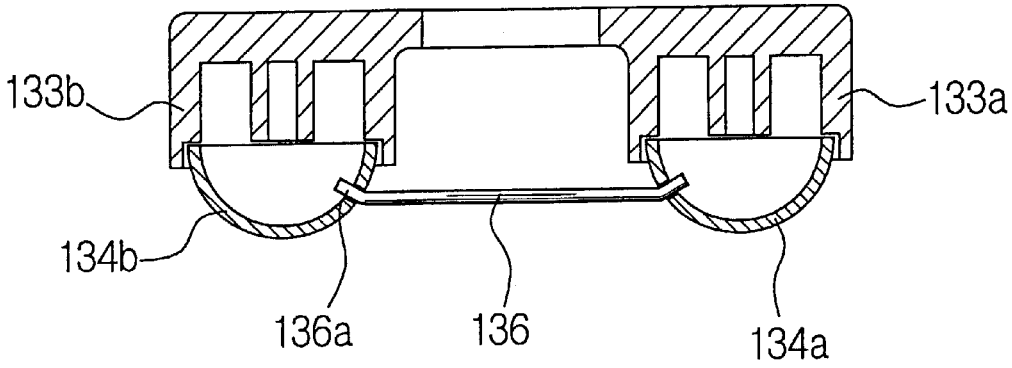
FIG. 6 is a sectional view taken approximately along line I—I of FIG. 5.

As shown in FIG. 6, the connecting pipe 136 has bent portions 136*a* formed on both ends of the connecting pipe 136. The bent portions 136*a* are bent for insertion into the inner walls of the first and the second muffler covers 134*a* and 134*b* at a predetermined angle. Accordingly, since both ends of the connecting pipe 136 are inserted in the first and the second muffler covers 134*a* and 134*b* by the length corresponding to the bent portions 136*a*, additional pulsation is prevented.

In the construction described above, the refrigerant compressed in the compressing chamber 131 stays in the refrigerant discharge chamber 62 (FIG. 1) of the cylinder head 60 for a predetermined time, and is respectively drawn through the first and the second refrigerant discharge ports 132*a* and 132*b*, to the refrigerant inflow sides 137*a* and 138*a* of the first and the second refrigerant channels 137 and 138. As the refrigerant flows through the refrigerant outflow sides 137*b* and 138*b*, which have smaller cross-sectional area than the refrigerant inflow sides 137*a* and 138*a*, the discharge pulsation of the refrigerant is decreased. The refrigerant flows to the first and the second discharge mufflers 133*a* and 133*b*.

The refrigerant, which is drawn to the second discharge muffler 133*b*, flows toward the first discharge muffler 133*a* through the connecting pipe 136, and the pulsation is again decreased. That is, since the refrigerant at the second discharge muffler 133*b* flows longer than the refrigerant at the first discharge muffler 133*a*, the streaming resistance is increased while the pulsation is decreased.

Especially when the sectional areas of the refrigerant inflow sides 137*a* and 138*a* of the first and the second refrigerant channels 137 and 138 are constant, the discharge pulsation of the refrigerant can be more efficiently reduced by varying the proportion of the cross-sectional area between the refrigerant outflow side 137*b* of the first refrigerant channel 137 and the refrigerant outflow side 138*b* of the second refrigerant channel 138 according to the exhaust air volume of the compressor.

According to the experiment results, the compressing efficiency deterioration is prevented and discharge pulsation of the refrigerant is substantially reduced with the cross-sectional diameters of the first and the second refrigerant channels 137 and 138, and the inner diameter of the connecting pipe 136 as follows:

Meanwhile, when the exhaust air volume of the compressor is 3.7–4.3 cc, relationship of the cross-sectional diameter of the refrigerant outflow side 137*b* of the first refrigerant channel 137, the cross-sectional diameter of the refrigerant outflow side 138*b* of the second refrigerant channel 138, and the inner diameter of the connecting pipe 136 is expressed approximately by 2:3.5:1.8. Accordingly, when the cross-sectional diameters of the refrigerant inflow sides 137*a* and 138*a* of the first and the second refrigerant channels 137 and 138 are 6.4 mm, respectively, the cross-sectional diameter of the refrigerant outflow side 137*b* of the first refrigerant channel 137 becomes 2.0 mm, the cross-sectional diameter of the refrigerant outflow side 138*b* of the second refrigerant channel 138 becomes 3.5, and the inner diameter of the connecting pipe 136 becomes 1.78 mm, respectively. As described, the cross-sectional diameter of the refrigerant outflow side 137*b* of the first refrigerant channel 137 and the inner diameter of the connecting pipe 136 of the compressor of air exhaust volume 3.7–4.3 cc are identical to those of the compressor of exhaust air volume 3.0. Only the cross-sectional diameter of the refrigerant outflow side 138*b* of the second refrigerant channel 138 of the compressor of exhaust air volume 3.7–4.3 cc is greater than the same of the compressor of exhaust air volume 3.0 cc.

Further, in the compressor of exhaust air volume of 5.2–6.2 cc, relationship of the cross-sectional diameter of the refrigerant outflow side 137*b* of the first refrigerant channel 137, the cross-sectional diameter of the refrigerant outflow side 138*b* of the second refrigerant channel 138, and the inner diameter of the connecting pipe 136 is expressed approximately by 2:3.5:2.2. That is, when the cross-sectional diameters of the refrigerant inflow sides 137*a* and 138*a* of the first and the second refrigerant channels 137 and 138 are 6.4 mm, respectively, the cross-sectional diameter of the refrigerant outflow side 137*b* of the first refrigerant channel 137 becomes 2.0 mm, the cross-sectional diameter of the refrigerant outflow side 138*b* of the second refrigerant channel 138 becomes 3.5 mm, and the inner diameter of the connecting pipe 136 becomes 2.16 mm, respectively. As described, the cross-sectional diameters of the first and the second refrigerant channels 137 and 138 of the compressor of the exhaust air volume 3.7–4.3 cc are identical to the same of the compressor of exhaust air volume 3.7–4.3 cc, while only the inner diameter of the connecting pipe 136 of the compressor of exhaust air volume 3.7–4.3 cc is greater than the same of the compressor of exhaust air volume 5.2–6.2 cc.

As the exhaust air volume of the compressor increases, by lengthening the cross-sectional diameter of the refrigerant outflow side 138*b* of the second refrigerant channel 138 or by lengthening the inner diameter of the connecting pipe 136, flow rate of the refrigerant flowing through the second refrigerant channel 138 and the connecting pipe 136 becomes appropriate, and accordingly, a possible compressing efficiency deterioration is prevented.

Figure 7:
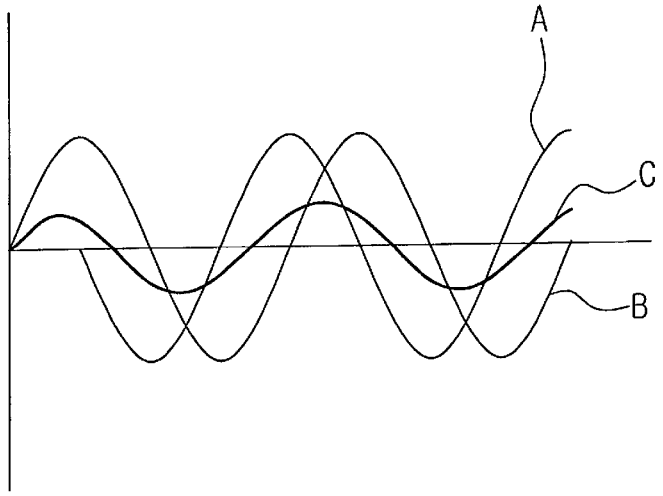
FIG. 7 is a graph showing pulsation waveforms of the discharged refrigerant in the reciprocating compressor according to the present invention.

Meanwhile, as shown in FIG. 7, there is phase difference of 90° between the waveform (A) of the pulsation of the

TABLE 1

| | 1st Refrigerant Channel | | 2nd Refrigerant Channel | | Connecting |
|---|---|---|---|---|---|
| | Inflow Side | Outflow Side | Inflow Side | Outflow Side | Pipe |
| 30 GRADE | Φ 6.4 mm | Φ 2.0 mm | Φ 6.4 mm | Φ 2.0 mm | Φ 1.78 mm |
| 37–43 GRADE | Φ 6.4 mm | Φ 2.0 mm | Φ 6.4 mm | Φ 3.5 mm | Φ 1.78 mm |
| 52–62 GRADE | Φ 6.4 mm | Φ 2.0 mm | Φ 6.4 mm | Φ 3.5 mm | Φ 2.16 mm |

In Table 1, the term 'GRADE' is the specification of the compressor according to the exhaust air volume thereof. Accordingly, '30 GRADE' is a compressor having an exhaust air volume of 3.0 cc, and '37 GRADE' is a compressor having exhaust air volume of 3.7 cc, or the like.

As shown in the above Table 1, when the exhaust air volume of the compressor is 3.0 cc, relationship between the cross-sectional diameter of the refrigerant outflow side 137*b* of the first refrigerant channel 137, the cross-sectional diameter of the refrigerant outflow side 138*b* of the second refrigerant channel 138, and an inner diameter of the connecting pipe 136 is expressed approximately by 2:2:1.8. Accordingly, when the cross-sectional diameters of the refrigerant inflow sides 137*a* and 138*a* of the first and the second refrigerant channels 137 and 138 are 6.4 mm, respectively, the cross-sectional diameter of the refrigerant outflow side 137*b* of the first refrigerant channel 137 becomes 2.0 mm, and the refrigerant outflow side 138*b* of the second refrigerant channel 138 becomes 2.0 mm, and the inner diameter of the connecting pipe 136 becomes 1.78 mm, respectively.

refrigerant drawn through the first refrigerant channel 137 to the first discharge muffler 133*a*, and the waveform (B) of the pulsation of the refrigerant drawn through the second refrigerant channel 138, the second discharge muffler 133*b*, and the connecting pipe 136, to the first discharge muffler 133*a*. Due to the phase difference, the waveforms (A and B) of the refrigerant interfere with each other in the first discharge muffler 133*a* and combined into a waveform (C) of pulsation, which has reduced amplitude and frequency. The refrigerant is discharged through the refrigerant discharge pipe 135.

Figure 8:
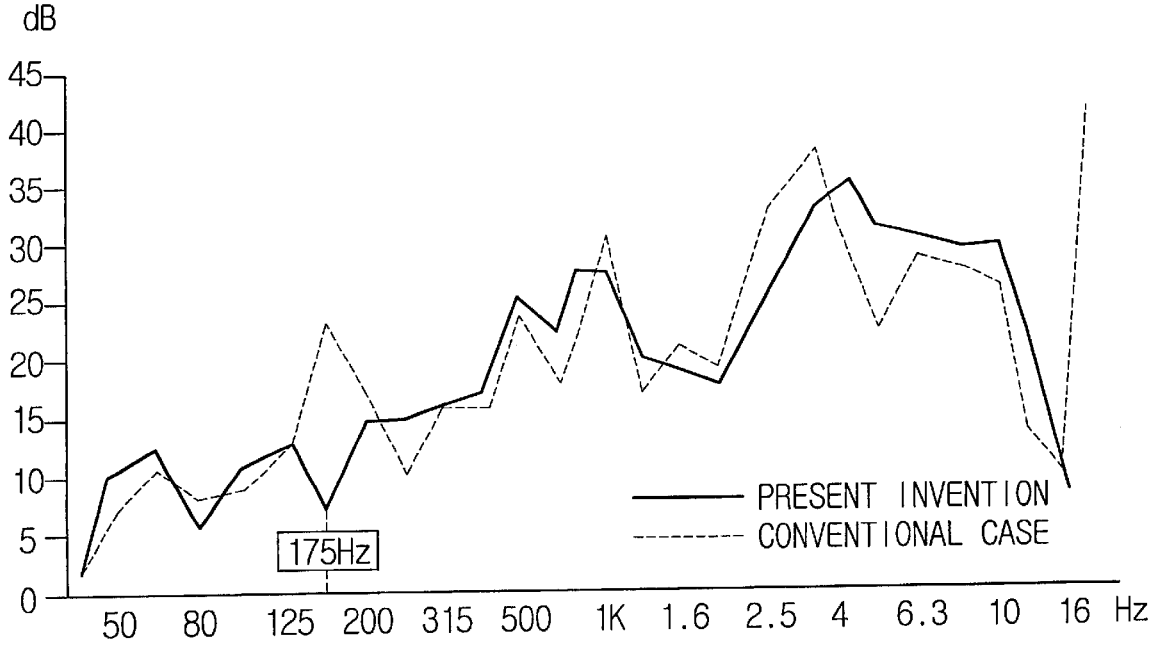
FIG. 8 is a graph showing noise levels detected during a comparison of the operation of the refrigerant compressor according to the present invention and a conventional refrigerant compressor.

FIG. 8 shows the noise level detected from the compressor having the first refrigerant channel 137, the second refrigerant channel 138, and the connecting pipe 136 formed according to the specification of Table 1. As shown in FIG. 8, the noise at a level of approximately 23 dB, detected from the conventional compressor in the frequency around 175 Hz, which causes resonance with other components of the freezing appliance, is substantially reduced to 7 dB in the compressor according to the present invention due to reduced pulsation during the refrigerant discharge.

Meanwhile, the combined refrigerant at the first discharge muffler 133*a* is discharged toward the condenser (not shown) through refrigerant discharge pipe 135 that is connected to the first muffler cover 134*a*.

As described above, according to the reciprocating compressor of the present invention, by forming the refrigerant inflow sides 137*a* and 138*a* of the first and the second refrigerant channel 137 and 138 to have smaller cross-sectional area than the refrigerant outflow sides 137*b* and 138*b*, and by varying the relational proportion between the cross-sectional areas of the refrigerant outflow side 137*b* of the first refrigerant channel 137, the refrigerant outflow side 138*b* of the second refrigerant channel 138, and the connecting pipe 136 according to the exhaust air volume of the compressor, the compressing efficiency of the compressor is not deteriorated, while the noise and vibration of the compressor are decreased. Particularly, according to the present invention, due to reduced noise at the low frequency range, the noise of the freezing appliance is also decreased.

Further, according to the present invention, while the refrigerant is respectively passed through the first and the second refrigerant channels 137 and 138 and then combined into one flow, the waveforms of the refrigerant interfere with each other, decreasing discharge pulsation of the refrigerant.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A reciprocating compressor comprising:

a pair of discharge mufflers disposed on a lower portion of a cylinder block;

first and second refrigerant channels interconnecting the pair of discharge mufflers and a refrigerant discharge chamber of a cylinder head;

a pair of muffler covers for sealing the pair of discharge mufflers, respectively;

a connecting pipe for connecting the pair of muffler covers with each other; and a refrigerant discharge pipe connected to one of the pair of muffler covers that is interconnected with the second refrigerant channel, the first and second refrigerant channels having refrigerant inflow sides which are connected to the refrigerant discharge chamber and have a predetermined cross-sectional area, and refrigerant outflow sides which are connected to the pair of discharge mufflers and have a cross-sectional area smaller than the cross-sectional area of the refrigerant inflow sides, and a discharge pulsation of refrigerant being reduced by varying a proportion between the cross-sectional areas of the refrigerant outflow side of the first refrigerant channel, the refrigerant outflow side of the second refrigerant channel, and the connecting pipe according to an exhaust air volume of the compressor, respectively, wherein the relationship between a cross-sectional diameter of the refrigerant outflow side of the first refrigerant channel, a cross-sectional diameter of the refrigerant outflow side of the second refrigerant channel, and an inner diameter of the connecting pipe is expressed approximately by the ratios 2:2:1.8.

2. The reciprocating compressor of claim 1, wherein a cross-sectional diameter of the refrigerant inflow sides of the first and the second refrigerant channels are 6.4 mm, respectively, and the cross-sectional diameter of the refrigerant outflow side of the first refrigerant channel is 2.0 mm, and the cross-sectional diameter of the refrigerant outflow side of the second refrigerant channel is 2.0 mm, and the inner diameter of the connecting pipe is 1.78 mm.

3. A reciprocating compressor comprising:

a pair of discharge mufflers disposed on a lower portion of a cylinder block;

first and second refrigerant channels interconnecting the pair of discharge mufflers and a refrigerant discharge chamber of a cylinder head;

a pair of muffler covers for sealing the pair of discharge mufflers, respectively;

a connecting pipe for connecting the pair of muffler covers with each other; and a refrigerant discharge pipe connected to one of the pair of muffler covers that is interconnected with the second refrigerant channel, the first and second refrigerant channels having refrigerant inflow sides which are connected to the refrigerant discharge chamber and have a predetermined cross-sectional area, and refrigerant outflow sides which are connected to the pair of discharge mufflers and have a cross-sectional area smaller than the cross-sectional area of the refrigerant inflow sides, and a discharge pulsation of refrigerant being reduced by varying a proportion between the cross-sectional areas of the refrigerant outflow side of the first refrigerant channel, the refrigerant outflow side of the second refrigerant channel, and the connecting pipe according to an exhaust air volume of the compressor, respectively, wherein the relationship between a cross-sectional diameter of the refrigerant outflow side of the first refrigerant channel, a cross-sectional diameter of the refrigerant outflow of the second refrigerant channel, and the inner diameter of the connecting pipe is expressed approximately by the ratios 2:3.5:1.8.

4. The reciprocating compressor of claim 3, wherein the cross-sectional diameter of the refrigerant inflow sides of the first and the second refrigerant channels are 2.0 mm, respectively, and the cross-sectional diameter of the refrigerant outflow side of the second refrigerant channel is 3.5 mm, and the inner diameter of the connecting pipe is 1.78 mm.

5. A reciprocating compressor comprising:

a pair of discharge mufflers disposed on a lower portion of a cylinder block;

first and second refrigerant channels interconnecting the pair of discharge mufflers and a refrigerant discharge chamber of a cylinder head;

a pair of muffler covers for sealing the pair of discharge mufflers, respectively;

a connecting pipe for connecting the pair of muffler covers with each other; and a refrigerant discharge pipe connected to one of the pair of muffler covers that is interconnected with the second refrigerant channel, the first and second refrigerant channels having refrigerant inflow sides which are connected to the refrigerant discharge chamber and have a predetermined cross-sectional area, and refrigerant outflow sides which are connected to the pair of discharge mufflers and have a cross-sectional area smaller than the cross-sectional area of the refrigerant inflow sides, and a discharge pulsation of refrigerant being reduced by varying a proportion between the cross-sectional areas of the refrigerant outflow side of the first refrigerant channel, the refrigerant outflow side of the second refrigerant channel, and the connecting pipe according to an exhaust air volume of the compressor, respectively, wherein a relationship between a cross-sectional diameter of the refrigerant outflow side of the first refrigerant channel, a cross-sectional diameter of the refrigerant outflow side of the second refrigerant channel, and the inner diameter of the connecting pipe is expressed approximately by the ratios 2:3.5:2.2.

6. The reciprocating compressor of claim 5, wherein the cross-sectional diameters of the refrigerant inflow sides of the first and the second refrigerant channels are 6.4 mm, respectively, and the cross-sectional diameter of the refrigerant outflow side of the first refrigerant channel is 2.0 mm, and the cross-sectional diameter of the refrigerant outflow side of the second refrigerant channel is 3.5 mm, and the inner diameter of the connecting pipe is 2.16 mm.

7. The reciprocating compressor of claim 1, wherein the connecting pipe has bent ends formed on both ends at a predetermined angle and inserted in the pair of muffler covers toward inner walls of the muffler covers.

8. The reciprocating compressor of claim 3, wherein the connecting pipe has bent ends formed on both ends at a predetermined angle and inserted in the pair of muffler covers toward inner walls of the muffler covers.

9. The reciprocating compressor of claim 5 wherein the connecting pipe has bent ends formed on both ends at a predetermined angle and inserted in the pair of muffler covers toward inner walls of the muffler covers.

* * * * *